United States Patent [19]

Bass et al.

[11] Patent Number: 4,579,538

[45] Date of Patent: Apr. 1, 1986

[54] CONSTRUCTION TOY

[75] Inventors: Sidney Bass, Los Angeles, Calif.; Yoshizo Seki, Tokyo, Japan

[73] Assignee: Tomy Kogyo Co. Inc., Toyko, Japan

[21] Appl. No.: 562,721

[22] Filed: Jan. 16, 1984

[30] Foreign Application Priority Data

Jan. 17, 1983 [JP] Japan ..... 58-4608

[51] Int. Cl.[4] ..... A63H 33/08

[52] U.S. Cl. ..... 446/107; 446/97; 446/120; 446/126

[58] Field of Search ..... 446/85, 89, 97, 99, 446/107, 109, 120, 121, 125, 124, 126, 385, 320, 268; D21/148, 155, 159, 167

[56] References Cited

U.S. PATENT DOCUMENTS

D. 193,101 6/1962 Grosso ..... D21/155 X
3,333,349 8/1967 Brumlik .
3,409,224 11/1968 Harp et al. .
3,453,359 7/1969 Clement et al. .
3,645,038 2/1972 Morrison et al. .
3,918,196 11/1975 Schleich ..... 446/97 X
4,335,539 6/1982 Jones .

*Primary Examiner*—Mickey Yu
*Attorney, Agent, or Firm*—K. H. Boswell

[57] ABSTRACT

A construction toy utilizes a plurality of tubular elements which are connectable to each other or are connectable to one or more hollow members. Each of the tubular elements has a first skirt on one end and a second skirt on its opposite end which are of the same size and are utilized to attach the elements to the hollow members. Further, attaching to one of the skirts on one of the ends is a smaller skirt which allows the smaller skirt to be attached to one of the skirts on a further of the tubular elements so as to connect two tubular elements together. The tubular elements have a plurality of convolutions which allow them to be expanded or contracted so as to lengthen or foreshorten the tubular elements as well as allowing the tubular elements to bend during the construction of structures with the components of the invention.

10 Claims, 5 Drawing Figures

CONSTRUCTION TOY

BACKGROUND OF THE INVENTION

This invention is directed to a construction toy which utilizes hollow tubular elements which are attachable to hollow members. The tabular elements have skirts on their ends which are connectable to one another or are connectable to the hollow members.

A variety of construction toys have fascinated endless numbers of children throughout the years. One of the more popular construction toys utilized wooden blocks having holes therein which were connected to wooden dowels by insertion of the dowels in the holes. This type of toy, while very utilitarian and having an exceedingly high play value, also had an inherent safety problem because it required the child to play with dowels of approximately quarter inch diameter, which unfortunately, could be stuck into eyes, ears and the like, causing physical harm.

Another very popular construction type toy utilized small metal girder-like members which were connected together using bolts and nuts. While this toy was very entertaining for the older child, because it required certain physical dexterity to connect the girders utilizing the bolts and nuts, the toy was not suitable for the smaller child who lacked the physical dexterity to make the proper attachment. This type of toy also had a safety disadvantage in that small children have an inherent desire to put small objects in their mouth, which could be swallowed or the like.

Other construction toys have included building blocks and the like which could be made into houses and other structures for the older style wooden blocks, and in all kinds of sophisticated structures for the modern Lego TM blocks. In playing with these blocks however, the child is limited with regard to the spatial conformations of the structures built because the blocks are inflexible and must inevitably be attached one to the other to construct the structure.

With the exception of the construction toy noted which utilized metal girders, the materials of the prior known construction toys were essentially inflexible, and as such, the child could not utilize his imagination to make all sorts of weird shapes and the like which are extremely fascinating to the child, and thus provide him with hours of entertainment. While the above noted metallic girders could be bent, this in fact was detrimental to the parts of this type of toy in that upon repeated flexing at a bend, the metal girders conceivably could snap. Furthermore, once the girder was bent, it was seemingly impossible for the child to straighten it out to its prior shape, and thus any bending of the girders was detrimental to the toy.

Recently, certain figure toys have been introduced which utilize corrugated plastic tubing which can be bent to assume different shapes. This same type of plastic tubing has found its way into other structures, such as drinking straws and the like. Unfortunately, in these toys, the design and engineering of the the flexible tubing was such that there was little flexibility with regard to attachment of the flexible tubing to other components and the child as such was somewhat limited with regard to the structures he could make, these essentially mimicking predetermined structures provided for by the manufacturer.

In view of the above, it is considered that there exits a need for new and improved construction toys which are both safe to use by young and old children alike, yet are also fascinating and entertaining to young and old children. Further, it is considered that there exists a need for new and improved construction toys which can be provided with a variety of interchangeable parts that allow the child to be very creative with regard to the types of structures which the child can assemble, and further it is considered that there exists a need for new and improved construction toys which utilize specific elements therein which verge into areas not previously incorporated into prior construction toys, such as musical enjoyment and the like.

BRIEF DESCRIPTION OF THE INVENTION

In view of the above, it is a broad object of this invention to provide for a new and improved construction toy. It is a further object of this invention to include in these new and improved construction toys a first type of element and a second type of element with the first type of element being a tubular element capable of being joined to the second type of element or to another tubular element, and the second type of element capable of forming a plurality of different structures used in conjunction with the first type of element. It is a further object of this invention to provide new and improved construction toys, which because of their design and engineering principles, are economical to manufacture and thus are available to a wide segment of the consuming public yet are safe in their use such that they can be used by small children without supervision.

These and other objects, as will become evident from the remainder of this specification are achieved in a toy which comprises at least one one piece intergally formed tubular element and at least one hollow member; said tubular element formed of a plastic material and having first and second ends connected by an element body; said tubular element body including a plurality of connected corrugations, said corrugations formed by alternating first and second truncated conical walls joined together base to base about circumferentially extending convex hinges and apex to apex about circumferentially extending concave hinges, said first conical walls shorter than said second conical walls such that they are nestable within said second conical walls; said first end of said tubular element including an axially extending first skirt having an outside surface of a first fixed diameter and an inside surface of a second fixed smaller diameter and including locking means on both said first skirt outside surface and said inside surface; said second end of said tubular element including an axially extending second skirt, a shoulder and an axially extending third skirt, said second skirt interspaced between said tubular element body and said third skirt and said shoulder interspaced between said second skirt and said third skirt, said second skirt having an outside surface of a fixed diameter equal to the diameter of said outside surface of said first skirt and including lock means on said outside surface of said second skirt, said third skirt having an outside surface sized so as to just fit within said inside surface of said first skirt and including lock means on said outside surface of said third skirt which engage said lock means on said inside surface of said first skirt to frictionally maintain said third skirt within said first skirt; at least one hollow member having at least on upstanding hollow boss located thereon and opening into the interior of said hollow member, said hollow boss of a size and a shape such that said first or said second skirts of said tubular element just fit within the inside diameter of said hollow boss with said lock means on said first or said second skirt frictionally engaging the interior of said hollow boss to frictionally maintain said element connected to said member.

Normally, at least two tubular elements would be utilized; however, preferredly, a plurality of tubular elements would be utilized such that the elements could be connected to one another in long chains, or could be connected to the hollow members. Further, it is preferable to include a plurality of hollow members with at lest some of the hollow members having a multiplicity of hollow bosses located thereon. As such, one of the tubular members could extend from one boss to a second boss on a single hollow member or one of the tubular members could connect two hollow members together.

Preferredly, the lock means on each of the skirts comprises a circumferentially extending protrusion which protrudes from the outside of the surface of the skirt. Additionally, the lock means on the first skirt can include a circumferentially extending groove, which projects concavely into the inside surface of the first skirt. As such, the projection on the outside surface of the third skirt of a first tubular element can lock with the groove on the inside skirt of a second tubular element to attach these two elements together.

Additionally preferredly, each of the hollow bosses on the hollow members would also have a circumferentially extending groove located within the boss with the protrusions on the first or second skirts locking with this groove to attach the tubular elements to the hollow members.

BRIEF DESCRIPTION OF THE DRAWINGS

In order to better understand this invention, reference is made to the drawings herein wherein.

This invention utilizes certain principles and/or concepts as are set forth in the claims appended to this specification. Those skilled in the toy arts will realize that these principles and/or concepts are capable of being utilized in a variety of embodiments differing from the illustrative embodiments herein. For this reason, this invention is not to be construed as being limited to the illustrative embodiments only, but is only to be construed as being limited by the claims.

DETAILED DESCRIPTION OF THE INVENTION

Figure 1:
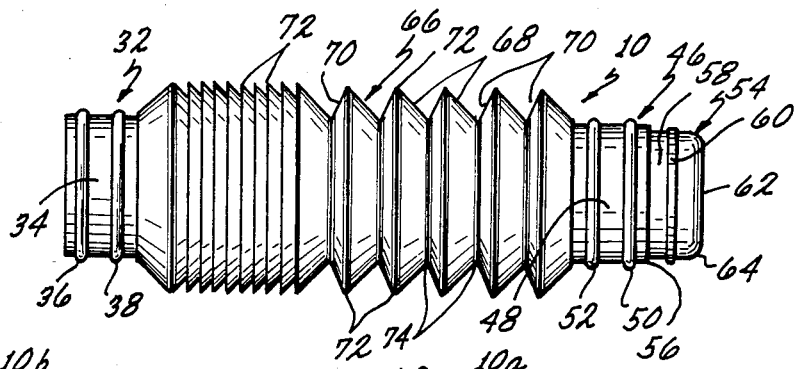
FIG. 1 is an elevational view of one of the components of the invention.
Figure 3:
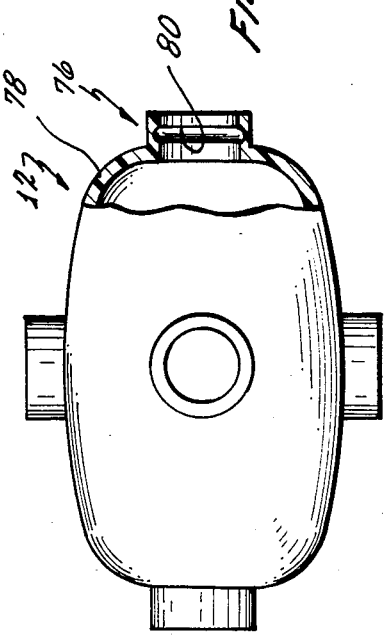
FIG. 3is an elevational view in partial section of a further component of the invention.

In the FIGS., in FIG. 1 there is shown a tubular element 10 and in FIG. 3 a hollow member 12. Further, in FIG. 4 other hollow members 16, 18 and 20 are shown, and in FIG. 5, further hollow members 22, 24, 26, 28 and 30 are shown.

One or more of the tubular elements 10 is utilized in conjunction with one of the hollow members, such as members 14 through 30, or other hollow members, to construct a variety of toys limited only by the imagination of a child. The tubular elements 10 are so constructed such that they can be connected together or they can be connected to any of the hollow members.

The tubular element 10 has a first skirt 32 on one end thereof. The first skirt 32 has an outside surface 34 of a fixed diameter which includes two circumferentially extending protruding ridges 36 and 38 located thereon. As is evident from viewing FIG. 2, the skirt 32 also includes an inside surface 40 which has grooves 42 and 44 located therein. The grooves 42 and 44 underlie the ridges 36 and 38 respectively, and in fact are formed during a single molding operation.

On the other end of the tubular element 10 is a second skirt 46 which also has an outside surface 48 with ridges 50 and 52 located thereon. The second skirt 46 in fact is a mimic of first skirt 32 with regard to size and shape, with either of the skirts 32 or 46 utilized to connect the tubular element 10 to one of the multiple hollow members.

On the same end of the tubular element 10 wherein the second skirt 46 is located, there is also located a third skirt 54. The third skirt 54 is separated from the second skirt 46 by a shoulder 56. This steps the tubular element 10 down from the outside surface 48 of the second skirt 46 to an outside surface 58 of the third skirt 54. The diameter of the outside surface 58 is sized incrementally smaller than the diameter of the inside surface 40 of the first skirt 32, allowing for insertion of the third skirt 54 into the interior of the first skirt 32.

Figure 2:
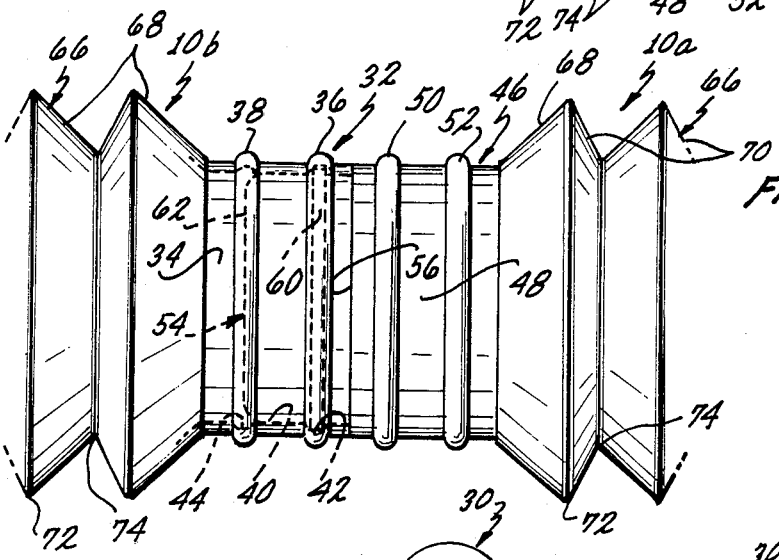
FIG. 2 is a fragmentary elevational view showing two of the components of FIG. 1 joined together.

The third skirt 54 includes a protruding ridge 60 located thereon which locks with groove 42 when a third skirt 54 of a first of the tubular elements 10 is attached to the first skirt 32 of a second tubular element 10. This is illustrated in FIG. 2 wherein the tubular element 10*a* on the right has its third skirt 54 inserted into the first skirt 32 on the tubular element 10*b* on the left.

The third skirt 54 also includes an end wall 62 which is connected to the third skirt 54 via a radius 64 such that the end of the tubular element 10 wherein third skirt 54 is located is rounded and is easily insertable into a first skirt 32 of a different tubular element 10. This assists a small child in aligning these members together to connect two tubular elements 10 together.

The tubular element 10 further includes a central body section 66. The body is composed of a plurality of convolutions which are made up of a first truncated conical wall 68 and a second truncated conical wall 70. The conical walls 68 and 70 are joined together apex to apex and base to base to form the convolutions. Wherein the base of a wall 68 joins the base of a wall 70 there is a convex circumferentially extending hinge 72. The hinge 72 allows the walls 68 and 70 to flex with respect to one another. Further, wherein the walls 68 and 70 join apex to apex, there is a circumferentially extending concave hinge 74. This also allows the walls 68 and 70 to flex with respect to one another.

The body 66 of the element 10 is formed of a plastic material as a one piece integrally formed unit. The walls 68 and 70 are capable of nesting one within the other in a manner shown in the left hand side of FIG. 1, or are capable of being extended by flexure about the hinges 72 and 74 such that they assume the shape as seen in the right hand side of FIG. 1. This allows the tubular dimension to a second, longer axial dimension, which is approximately two times the length of the first dimension. It is realized that the element 10 can have its body 66 only partially flexed, as seen in FIG. 1, or there can be a multiple of flexed areas interspaced by unflexed areas. A similar type tube structure is shown in U.S. Pat. No. 3,645,038, the disclosure is herein incorporated by reference with regard to the body 66 of the tubular element 10. By making the wall 70 slightly shorter than the wall 68, the body 66 of the tubular element 10 is nestable as is seen in FIG. 1.

The hollow members 14 through 30 all include at least one boss which is illustrated in FIG. 3 in detail. Insofar as all of the bosses utilized for any of the hollow members 14 through 30 would be identical, a single numeral 76 is utilized to identify these bosses. The boss 76 projects from the body 78 of the hollow member 12, as is seen in FIG. 3. It has an internal diameter which is just slightly larger than the diameter of the outside surface 34 of the first skirt 32 or the outside surface 48 of the second skirt 48. This allows insertion of either the first skirt 32 or the second skirt 46 of one of the tubular elements 10 into the bosses 76 to connect the tubular elements 10 to one of the hollow members, i.e., hollow member 12.

In the interior of the boss 76 is a circumferentially extending groove 80 which is sized and shaped so as to accept either the ridge 36 on the first skirt 32 or the ridge 50 on the second skirt 46. This locks either the first or second skirts 32 or 46 of a tubular element 10 to the boss 76 to attach one of the tubular elements 10 to one of the hollow members.

Figure 4:
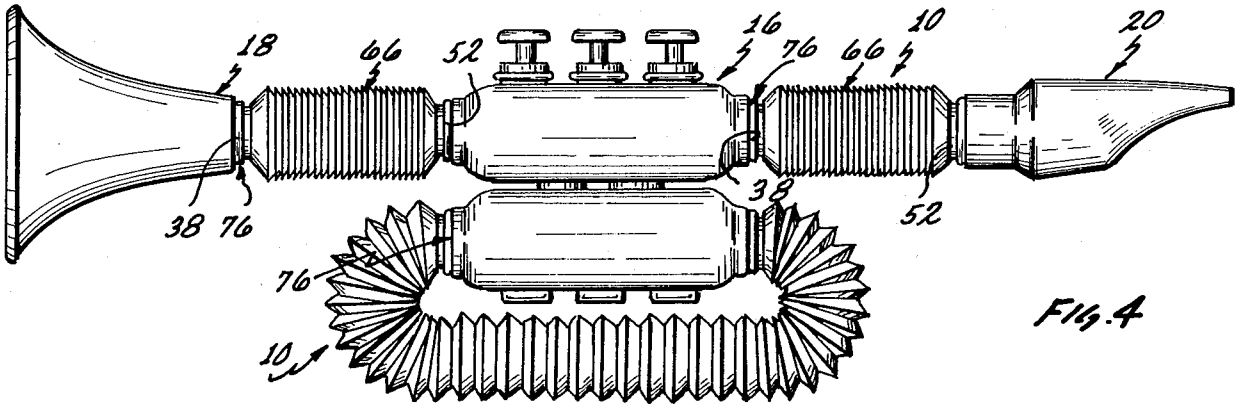
FIG. 4 is an elevational view showing a component of FIG. 1 being utilized in conjunction with additional components; and FIG .4 is an isometric view of the components of FIG. 1 in use with further additional components of the invention.

As can be seen in FIG. 3, there are a plurality of the bosses 76 on the body 12. Further as can be seen in FIG. 4, for the hollow member 16, which is shaped as the control portion of a trumpet, there are also a plurality of the bosses 76. This is also true of the hollow member 22 utilized in FIG. 5 for construction of the figure seen therein.

Certain of the hollow members, such as members 18 and 20, which mimic the bell and mouthpiece of a trumpet, as seen in FIG. 4, have but a single boss 76. Additionally, other hollow members such as the foot units 24 or the hand units 26 or the eye units 30 of the figure seen in FIG. 5, also have a singular boss 76.

Figure 5:
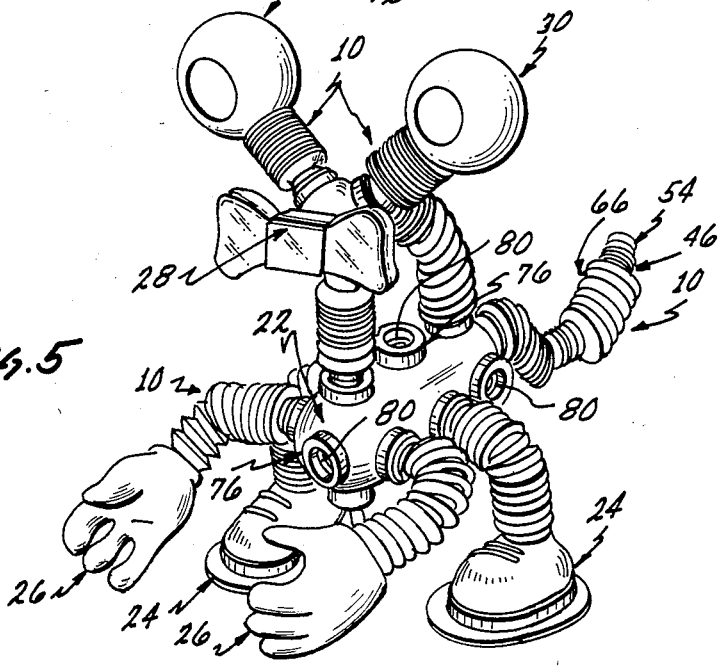

It is evident that a plurality of different hollow members could be utilized with a plurality of tubular elements 10 to construct instruments such as that seen in FIG. 4, or figures, such as seen in FIG. 5. Further, long chains of the tubular elements 10 can be utilized to construct other types of figures and these chains, or a single tubular member 10 can be curved as is seen in both FIGS. 4 and 5, in order to lend different degrees of freedom to the child in making structures with the construction components of this invention.

Because the tubular elements 10 have both a first and second skirt on opposite ends, they can be attached in a coiled manner to a same hollow member, such as is seen in FIG. 6, wherein one of the tubular elements 10 is attached to different bosses 76 on the same hollow member 16. The unique construction of the tubular elements 10 wherein they have identical skirts, i.e., skirts 32 and 46 on opposite ends, as well as a connecting skirt, i.e., skirt 54, on one of the ends, allows for versatility in constructing different structures utilizing the elements of the invention.

We claim:

1. A toy which comprises:

at least one one piece intergally formed tubular element and at least one hollow member;

said tubular element formed of a plastic material and having first and second ends connected by an element body;

said tubular element body including a plurality of connected corrugations, said corrugations formed by alternating first and second truncated conical walls joined together base to base about circumferentially extending convex hinges and apex to apex about circumferentially extending concave hinges, said first conical walls shorter than said second conical walls such that they are nestable within said second conical walls;

said first end of said tubular element including an axially extending first skirt having an outside surface of a first fixed diameter and an inside surface of a second fixed smaller diameter and including locking means on both said first skirt outside surface and said inside surface;

said second end of said tubular element including an axially extending second skirt, a shoulder and an axially extending third skirt, said second skirt interspaced between said tubular element body and said third skirt and said shoulder interspaced between said second skirt and said third skirt, said second skirt having an outside surface of a fixed diameter equal to the diameter of said outside surface of said first skirt and including lock means on said outside surface of said second skirt, said third skirt having an outside surface sized so as to just fit within said inside surface of said first skirt and including lock means on said outside surface of said third skirt which engage said lock means on said inside surface of said first skirt to frictionally maintain said third skirt within said first skirt;

at least one hollow member having at least one upstanding hollow boss located thereon and opening into the interior of said hollow member, said hollow boss of a size and a shape such that said first or said second skirts of said tubular element just fit within the inside diameter of said hollow boss with said lock means on said first or said second skirt frictionally engaging the interior of said hollow boss to frictionally maintain said element connected to said member.

2. The toy of claim 1 including:

at least two of said tubular elements, the first skirt of said tubular elements connectable to said hollow boss or to the third skirt of a further of said tubular elements, the second skirt of said tubular elements connectable to said hollow boss and the third skirt of each of said tubular elements connectable to the first skirt on a further of said tubular elements.

3. The toy of claim 3 wherein:

said lock means includes at least one circumferentially extending protrusion convexly projecting from the outside surface of the respective first, second or third skirt.

4. The toy of claim 3 wherein:

said lock means further includes at least one circumferentially extending groove concavely projecting into the inside surface of at least said first skirt, said groove sized and shaped so as to except and mate with the circumferentially extending protrusion of said third skirt.

5. The toy of claim 4 including:

said hollow boss including at least one circumferentially extending boss groove concavely protecting into the inside surface of said hollow boss, said boss groove sized and shaped so as to except and mate with the circumferentially extending protrusion on said first and said second skirts.

6. The toy of claim 5 including:

said hollow member having a plurality of said hollow bosses located thereon.

7. The toy of claim 5 including:

a plurality of said tubular elements, the first skirt of each of said tubular elements connectable to one of said hollow bosses or to the third skirt of a further of said tubular elements, the second skirt of each of said tubular elements connectable to one of said hollow bosses and the third skirt of each of said tubular elements connectable to the first skirt on a further of said tubular elements.

8. The toy of claim 6 including:

an end wall located on said third skirt and joining said third skirt at a radius of curvature such that said third skirt curves smoothly into said end wall.

9. The toy of claim 8 including:

a plurality of hollow members each having at least two hollow boss located thereon.

10. The toy of claim 9 wherein:

at least one of said hollow member has only one of said hollow bosses located thereon.

* * * * *

UNITED STATES PATENT AND TRADEMARK OFFICE

CERTIFICATE OF CORRECTION

PATENT NO. : 4,579,538

DATED : APRIL 1, 1986

INVENTOR(S) : SIDNEY BASS, YOSHIZO SEKI

It is certified that error appears in the above-identified patent and that said Letters Patent is hereby corrected as shown below:

Column 1,line 3, "tabular" should be --tubular--.
Column 2, line 66, "on" should be --one--.
Column 3, line 12, "lest" should be --least--.
Column 3, line 49, "Fig .4" should be --Fig. 5--.
Column 4, line 68, after the word "tubular" insert the missing phrase --element 10 to go from a very first, small axial--.
Column 5, line 21, "48" should be --41--.
Column 5, line 58, "a" should be --the--.
Column 6, line 56, "toy of claim 3" should be --toy of claim 2--.
Column 6, line 65, "except" should be --accept--.
Column 7, line 2, "protecting" should be --projecting--.
Column 7, line 4, "except" should be --accept--.
Column 8, line 11, "boss" should be --bosses--.
Column 8, line 13, "member" should be --members--.

Signed and Sealed this

Eighteenth Day of November, 1986

*Attest:*

DONALD J. QUIGG

*Attesting Officer* *Commissioner of Patents and Trademarks*